US006425333B2

(12) United States Patent
Theurer et al.

(10) Patent No.: US 6,425,333 B2
(45) **Date of Patent: *Jul. 30, 2002**

(54) LOADING CAR FOR BULK MATERIALS

(75) Inventors: Josef Theurer, Vienna; Herbert Wörgötter, Gallneukirchen, both of (AT)

(73) Assignee: Franz Plasser Bahnbaumaschinen-Industriegesellschaft m.b.H., Vienna (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/773,952

(22) Filed: Feb. 1, 2001

(30) Foreign Application Priority Data

Feb. 18, 2000 (AT) ..... 116/00 U

(51) Int. Cl.[7] ..... E01B 29/02
(52) U.S. Cl. ..... 104/2; 104/5
(58) Field of Search ..... 104/2, 5; 105/355

(56) References Cited

U.S. PATENT DOCUMENTS 5,727,474 A * 3/1998 Theurer et al. ..... 105/355
5,993,131 A * 11/1999 Theurer et al. ..... 414/339
6,089,162 A * 7/2000 Madison ..... 104/2

* cited by examiner

*Primary Examiner*—S. Joseph Morano
*Assistant Examiner*—Robert J. McCarry, Jr.
(74) *Attorney, Agent, or Firm*—Henry M. Feiereisen

(57) ABSTRACT

A loading car for bulk materials includes a vehicle undercarriage frame defining a longitudinal axis and including first and second car frames connected to one another by a coupler. Rail undercarriages are provided for supporting the vehicle undercarriage frame for mobility on a railroad track. A carrying frame is mounted on the first and second car frame by means of swivel rings, with a storage box built on the carrying frame. A bottom conveyor belt having a discharge end is deposited in the storage box, and a transfer conveyor belt extending at an angle to a horizontal plane is associated with the discharge end of the bottom conveyor belt. Disposed between the storage box and the first and second car frames are supported members, each of which including two hydraulic cylinders positioned opposite one another transversely to the longitudinal axis.

31 Claims, 2 Drawing Sheets

LOADING CAR FOR BULK MATERIALS

CROSS-REFERENCES TO RELATED APPLICATIONS

This application claims the priority of Austrian Patent Application, Serial No. GM 116/2000, filed Feb. 18, 2000, the subject matter of which is incorporated herein by reference.

BACKGROUND OF THE INVENTION

The present invention relates, in general, to a loading car for bulk materials, and more particularly but not exclusively to a loading car of a type having a storage box with a bottom conveyor belt with which a transfer conveyor belt is associated, wherein the storage box is mounted by swivel rings on a vehicle undercarriage frame which is supported for mobility on a railroad track by rail undercarriages and includes first and second car frames connected to one another by a coupler.

U.S. Pat. No. 5,993,131 describes a loading car for bulk materials with an elongated vehicle undercarriage frame which is supported by rail undercarriages on a track. The vehicle undercarriage frame is composed of two car frames which are arranged following one another on a railroad track and are connected to one another by a coupler. A storage box having a carrying frame is supported on each of the car frames by means of a respective swivel ring, one of which is longitudinally shiftable in order to allow a movement of the storage box relative to the car frames when the car is traveling through track curves. Support members are positioned between the storage box, or rather the carrying frame, and the car frames of the vehicle undercarriage frame to provide lateral stability. These support members are designed as helical springs which serve to transfer the load of the storage box to the vehicle undercarriage frame.

German utility model document DE 92 14 176 U1 also shows a loading car for bulk materials, having two car frames which are articulatedly connected to one another and on which a storage box with a bottom conveyor belt is supported.

SUMMARY OF THE INVENTION

It is an object of the present invention to provide an improved loading car which ensures a best possible distribution of load to the supporting rail undercarriages situated between the swivel rings.

These objects, and others which will become apparent hereinafter, are attained in accordance with the present invention by a loading car for bulk materials which comprises a vehicle undercarriage frame extending in a longitudinal direction and having a first car frame and a second car frame connected to one another by means of a coupler. Rail undercarriages are provided for supporting the vehicle undercarriage frame for mobility on a railroad track. A carrying frame is mounted on the first and the second car frame, respectively, by means of a swivel ring in each case, and a storage box is built on the carrying frame. A bottom conveyor belt is disposed in the storage box and has a discharge end, and a transfer conveyor belt is associated with the discharge end of the bottom conveyor belt and extends at an angle to a horizontal plane. Support members are disposed between the storage box and the first and second car frame, respectively, and comprise in each case two hydraulic cylinders positioned opposite one another transversely to the longitudinal direction.

The use of hydraulic cylinders as support members for the storage box makes it possible in an advantageous way to very easily and in a simple manner adjust the supporting force acting upon the storage box or on the carrying frame. Thus, it is possible to take into account the different weight of the storage box when it is either completely filled or in an empty condition, or in any of the stages in-between. In this way, it is consequently possible to achieve an optimal load distribution to the rail undercarriages, particularly those which are situated centrally with regard to the longitudinal direction, so that the maximum permissible axial loads can be utilized fully without exceeding the highest prescribed limits. In connection with the use of a pressure storage unit, the hydraulic cylinders of the support members can be actuated without difficulty also during transfer travel of the loading car, during which the hydraulic motor may be shut off.

According to a preferred embodiment of the invention, there is provided at each location of a support member a transverse beam, extending perpendicularly to the longitudinal direction and fastened in each case to the first or second car frame, respectively. Each hydraulic cylinder of each support member is articulatedly connected with one end to the respective first or second car frame and with its other end to the transverse beam by means of a pivot joint.

According to yet another aspect of the invention, two of said transverse beams are provided at each respective location, the two beams lying opposite one another transversely to the longitudinal direction, with each beam having an end positioned centrally of the car. Further, each beam is fastened with said end to the respective car frame by means of a pivot joint having an axis extending in the longitudinal direction.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF A PREFERRED EMBODIMENT

Figure 1:
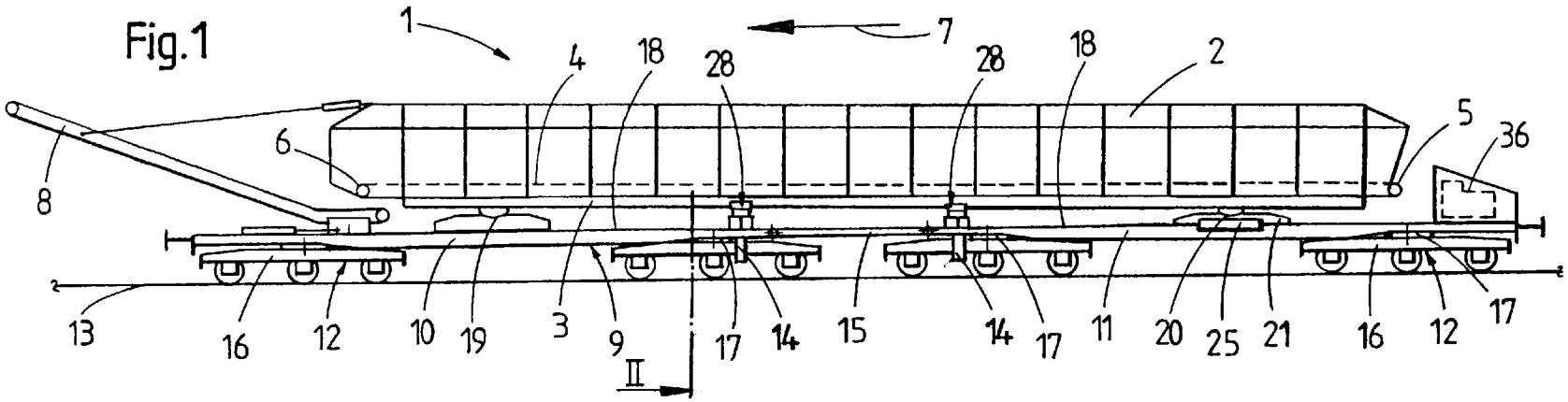
FIG. 1 is a side elevational view of one embodiment of a loading car for bulk materials, having support members positioned between the storage box and the car frames.

Throughout all the Figures, same or corresponding elements are generally indicated by same reference numerals.

Turning now to the drawing, and in particular to FIG. 1, there is shown a side elevational view of one embodiment of a loading car 1 for bulk materials, with a storage box 2 of elongated design which is open at the top. The storage box 2 is erected on a carrying frame 3 and equipped with a bottom conveyor belt 4 which extends over the entire length of the box, forming the bottom thereof. The conveying direction of the bottom conveyor belt 4—having a receiving end 5 and a discharge end 6—is indicated by an arrow 7. The discharge end 6 of the bottom conveyor belt 4 is associated with a transfer conveyor belt 8 arranged at an angle to the horizontal plane and sloping upwardly.

The storage box 2, by way of the carrying frame 3, is supported on a vehicle undercarriage frame 9, extending in a longitudinal direction, on which the transfer conveyor belt 8 is also mounted. The vehicle undercarriage frame 9 is composed of a first car frame 10 and a second car frame 11, each of which is supported for mobility on a railroad track 13 by means of two rail undercarriages 12 positioned at the longitudinal ends of the car frames 10 and 11 and designed as triaxial bogies 16, each having a pivot pin 17. The two car frames 10, 11, arranged one immediately following the other in the longitudinal direction, are articulatedly connected to one another by means of a coupler 15 in the shape of a coupling rod, each car frame exhibiting a plane, horizontal loading platform 18.

For the purpose of supporting the carrying frame 3 on the first and second car frames 10, 11 of the vehicle undercarriage frame 9, two swivel rings 19, 20 are provided and spaced from one another in the longitudinal direction. Each swivel ring 19, 20 is positioned in the region between the two pivot pins 17 of the bogies 16 of the respective car frame 10 or 11 and in the transverse center of the loading car 1 or the carrying frame 3. The swivel ring 19, located forwardly with regard to the conveying direction (arrow 7), is fixedly connected to the loading platform 18 of the front car frame 10. The rearward swivel ring 20, on the other hand, is designed to be displaceable in the longitudinal direction relative to the car frame 11 on which it is mounted. Toward that end, the swivel ring 20 is fastened in the center of a flat carriage 21 shaped flatly, the width of which corresponds approximately to the width of the loading platform 18. The carriage 21 is further equipped with a number of rollers (not shown in the drawing) which rest on the loading platform 18 and are designed for rolling thereon in the longitudinal direction. Also arranged between the carriage 21 and the car frame 11 is a tilt protection device 25 which is intended to prevent the carriage 21 from pivoting laterally and lifting off the loading platform 18.

Provided between the carrying frame 3 of the storage box 2 and the two car frames 10, 11 are support members 28. These serve to stabilize the storage box 2 with regard to lateral pivoting, and also to transmit the load of the box to the rail undercarriages 12 disposed thereunder. A total of four support members 28 are arranged in two pairs, each pair being positioned above a rail undercarriage 12 in the area between the two swivel rings 19, 20 and comprising two support members 28 spaced from one another in the transverse direction. The support members 28 are designed as hydraulic cylinders 14 which are connected to a pressure storage unit 23 by means of hydraulic lines 22 (see FIG. 5).

Figure 4:
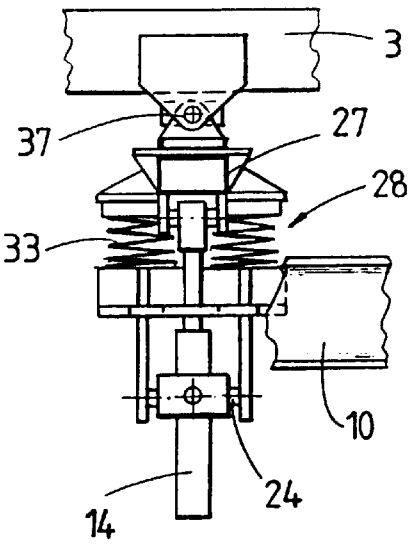
FIG. 4 is a side elevational view of a support member.
Figure 2:
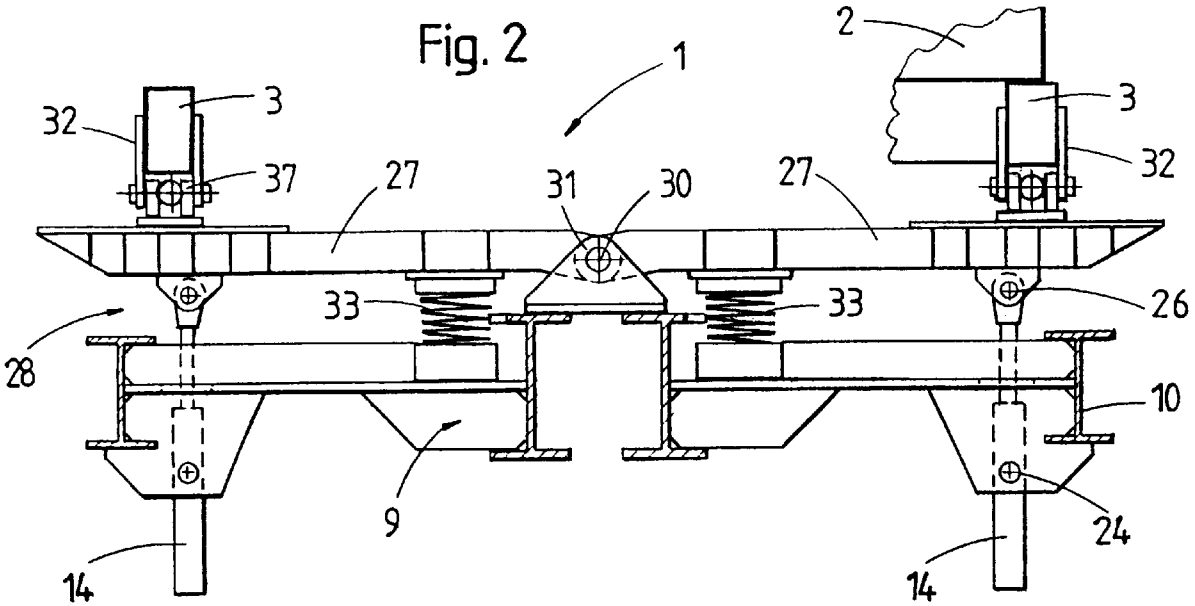
FIG. 2 is a cross-sectional view of the loading car in the region of the support members, taken along the line 11 in FIG. 1.
Figure 3:
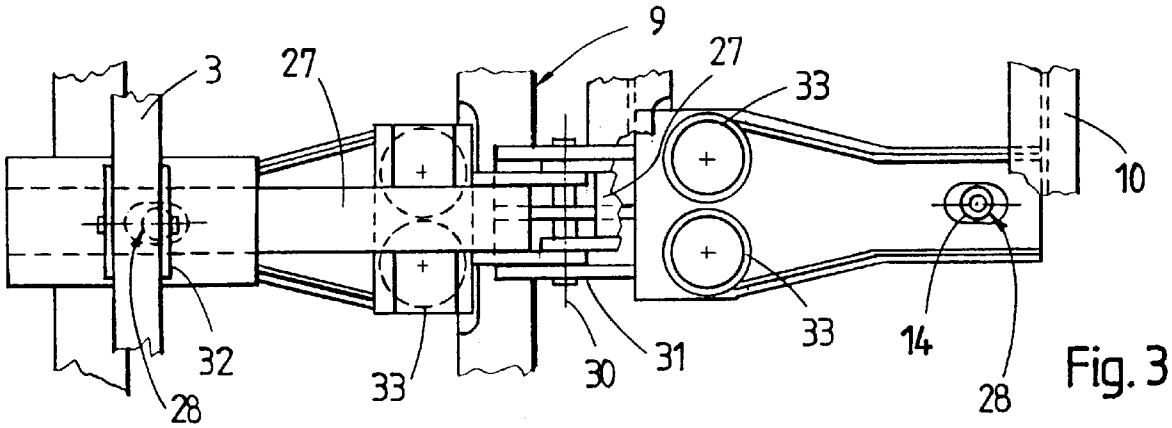
FIG. 3 is a top view of the support members arranged in opposite relationship transversely to the longitudinal direction of the car.

As can be seen in detail in FIGS. 2 to 4, at each location of a pair of support members 28, two transverse beams 27 are provided and arranged end to end, lying opposite one another in the transverse direction and extending perpendicularly to the longitudinal direction. At the end positioned in the transverse center of the loading car 1, each of the transverse beams 27 is connected to the respective car frame 10 or 11 by means of a pivot joint 31 having an axis 30 extending in the longitudinal direction. Each hydraulic cylinder 14 of each support member 28 is connected at one end to the car frame 10 or 11 by means of a pivot joint 24, while the other, upper end of each hydraulic cylinder 14 is connected to one of the transverse beams 27 by means of a further pivot joint 26. Additionally, each support member 28 comprises a U-shaped mounting 32 for support on the carrying frame 3, extending in the longitudinal direction, of the storage box 2. The mountings 32 are in each case connected by means of a universal joint 37 to one of the transverse beams 27 in an end region thereof distanced from the centrally positioned pivot joint 31.

As can be seen particularly well in FIGS. 3 and 4, two springs 33 are provided in each case between the transverse beam 27 and the car frame 10 (or 11) in the region of the central pivot joint 31, the two springs being positioned one following the other in the longitudinal direction.

Figure 5:
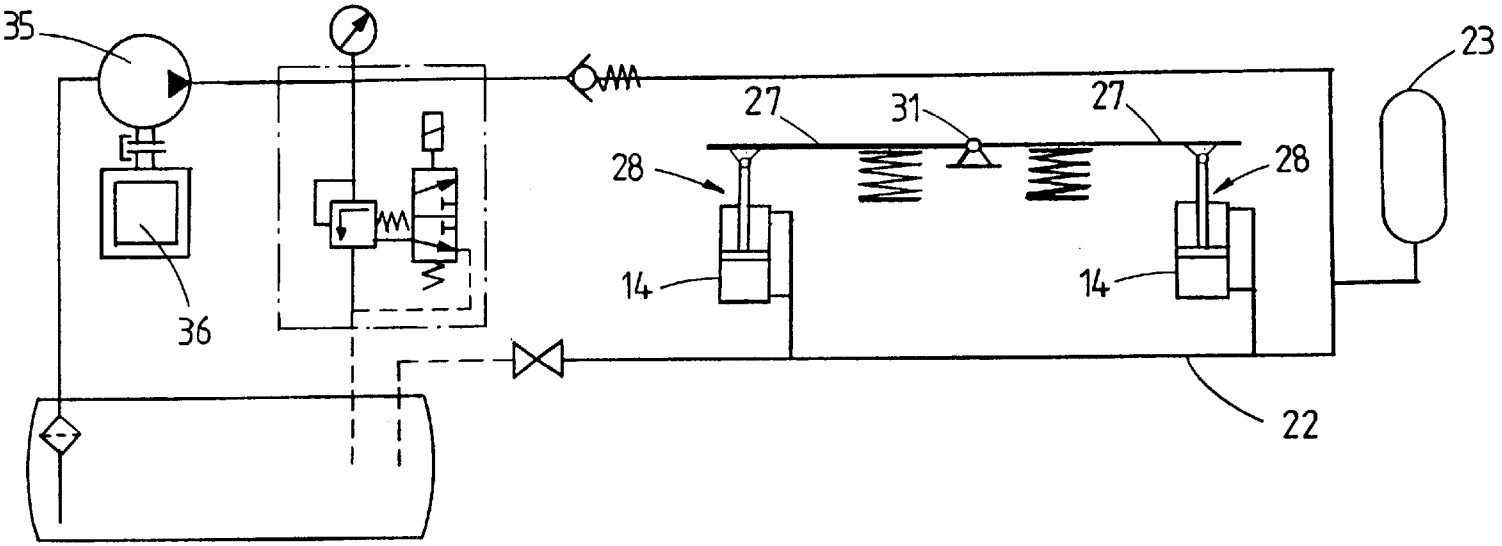
FIG. 5 is a simplified schematic diagram of a hydraulic system associated with the support members.

As shown in the diagram in FIG. 5, a hydraulic pump 35 is driven by a motor 36 situated on the loading car 1. The pump 35 is connected to the hydraulic cylinder 14 of the support members 28 by means of hydraulic lines 22 which are also connected to a pressure storage unit 23. As soon as the desired operating pressure has built up in the pressure storage unit 23, it is possible to shut off the motor 36, for instance during transfer travel of the loading car, without thereby incurring a loss of the support members 28 or causing any other problems.

While the invention has been illustrated and described as embodied in a loading car for bulk materials, it is not intended to be limited to the details shown since various modifications and structural changes may be made without departing in any way from the spirit of the present invention.

What is claimed as a new and desired to be protected by Letters Patent is set fourth in the appended claims:

What is claimed is:

1. A loading car for bulk materials, comprising:

a vehicle undercarriage frame extending in a longitudinal direction and having a first car frame, a second car frame and a coupler for interconnecting the first and second car frames;

rail undercarriages supporting the vehicle undercarriage frame for mobility on a railroad track;

a carrying frame mounted on the first and the second car frame, respectively, by means of a swivel ring in each case;

a storage box built on the carrying frame;

a bottom conveyor belt disposed in the storage box and having a discharge end;

a transfer conveyor belt associated with the discharge end of the bottom conveyor belt and extending at an angle to a horizontal plane; and support members disposed between the storage box and the first and second car frame, respectively, and comprising in each case two hydraulic cylinders positioned opposite one another transversely to the longitudinal direction.

2. The loading car of claim 1, wherein at each location of a support member a transverse beam is provided, extending perpendicularly to the longitudinal direction and fastened in each case to the first or second car frame, respectively, and wherein each hydraulic cylinder of each support member is articulatedly connected with one end to the respective first or second car frame and with its other end to the transverse beam by means of a pivot joint.

3. The loading car of claim 2, wherein two of said transverse beams are provided at each respective location, the two beams lying opposite one another transversely to the longitudinal direction and each beam having an end positioned centrally of the car, and wherein further each beam is fastened with said end to the respective car frame by means of a pivot joint having an axis extending in the longitudinal direction.

4. The loading car of claim 1, wherein each support member further comprises a U-shaped mount for attachment to the carrying frame supporting the storage box.

5. The loading car of claim 4, wherein each U-shaped mount is connected by a universal joint to one of the transverse beams in an end region thereof distanced from the centrally positioned pivot joint.

6. The loading car of claim 2, further comprising a spring arranged in each case between the transverse beam and the first or second car frame, respectively.

7. The loading car of claim 6, wherein the spring is arranged in an end region of the of the transverse beam adjoining the centrally positioned pivot joint.

8. The loading car of claim 1, wherein two pairs of supporting members, spaced from one another in the longitudinal direction, are provided in the region between the swivel rings.

9. The loading car of claim 1, wherein the support members are arranged in each case above a respective one of the rail undercarriages.

10. A loading car for bulk materials, comprising:

a vehicle undercarriage frame defining a longitudinal axis and having a first car frame, a second car frame, and a coupler for interconnecting the first and second car frames;

a plurality of rail undercarriages for supporting the vehicle undercarriage frame for mobility on a railroad track;

a carrying frame;

a swivel ring assembly for mounting the carrying frame on the undercarriage frame;

a storage box mounted on the carrying frame and including a bottom conveyor belt having a discharge end for transfer of bulk material to a slanted transfer conveyor belt; and a support structure disposed between the storage box and the undercarriage frame, said support structure including two hydraulic cylinders in opposite relationship transversely to the longitudinal axis.

11. The loading car of claim 10, wherein the support structure includes a transverse beam extending perpendicular to the longitudinal axis and secured to the undercarriage frame, each said hydraulic cylinder having one end articulated to the undercarriage frame and another end pivoted to the transverse beam.

12. The loading car of claim 11, wherein the transverse beam has two beam parts placed in confronting disposition in a direction transversely to the longitudinal axis, said support structure including a pivot joint for pivotally connecting confronting ends of the beam parts at a central location of the undercarriage frame, with the pivot joint defined by an axis extending longitudinally in the direction of the longitudinal axis.

13. The loading car of claim 11, wherein the support structure includes a U-shaped mount for attachment to the carrying frame supporting the storage box.

14. The loading car of claim 13, wherein the U-shaped mount includes a universal joint for securement to an end region of the transverse beam.

15. The loading car of claim 12, wherein the support structure includes two U-shaped mounts for attachment to the carrying frame supporting the storage box.

16. The loading car of claim 15, wherein the U-shaped mounts are connected to the beam parts in one-to-one correspondence and each of the U-shaped mounts includes a universal joint for securement to an end region of the beam parts at a distance to the pivot joint.

17. The loading car of claim 11, wherein the support structure includes a spring arranged between the transverse beam and the undercarriage frame.

18. The loading car of claim 12, wherein the support structure includes a first spring arranged between one of the beam parts and the undercarriage frame in proximity of the pivot joint, and a second spring arranged between the other one of the beam parts and the undercarriage frame in proximity of the pivot joint.

19. The loading car of claim 11, wherein the swivel ring assembly includes two swivel rings, and further comprising two of said support structure positioned in spaced-apart disposition longitudinally in the direction of the axis between the swivel rings.

20. The loading car of claim 11, wherein the support structure is arranged above the rail undercarriages.

21. A loading car, comprising:

a frame defining a longitudinal axis and supported by undercarriages for mobility on a railroad track;

a storage box;

a swivel assembly for mounting the storage box to the frame;

a support structure disposed between the storage box and the frame and including two hydraulic cylinders in opposite relationship transversely to the longitudinal axis for prop-up of the storage box at a supporting force which depends on a filling degree of material in the storage box.

22. The loading car of claim 21, wherein the support structure includes a transverse beam extending perpendicular to the longitudinal axis and secured to the frame, each said hydraulic cylinder having one end articulated to the frame and another end pivoted to the transverse beam.

23. The loading car of claim 22, wherein the transverse beam has two beam parts placed in confronting disposition in a direction transversely to the longitudinal axis, said support structure including a pivot joint for pivotally connecting confronting ends of the beam parts at a central location of the frame.

24. The loading car of claim 22, wherein the support structure includes a U-shaped mount, secured to the transverse beam, for support of the frame.

25. The loading car of claim 24, wherein the U-shaped mount includes a universal joint for securement to an end region of the transverse beam.

26. The loading car of claim 21, wherein the support structure includes a spring arranged between the transverse beam and the frame.

27. The loading car of claim 21, wherein the swivel assembly includes two swivel rings, and further comprising two of said support structure positioned in spaced-apart disposition longitudinally in the direction of the axis between the swivel rings.

28. A support structure for assisting a prop-up of a storage box on an undercarriage frame of a loading car in dependence on a filling degree of material in the storage box, said support structure comprising:

a pair of hydraulic cylinders arranged next to one another in opposite relationship transversely to a longitudinal axis of a loading car; and a transverse beam extending perpendicular to the longitudinal axis and secured to the undercarriage frame of the loading car, each said hydraulic cylinder having one end articulated to the undercarriage frame and another end pivoted to the transverse beam.

29. The support structure of claim 28, and further comprising a U-shaped mount, secured to the transverse beam, for support of the storage box.

30. The support structure of claim 29, wherein the U-shaped mount includes a universal joint for securement to an end region of the transverse beam.

31. The support structure of claim 28, and further comprising a spring assembly arranged between the transverse beam and the undercarriage frame.

* * * * *

UNITED STATES PATENT AND TRADEMARK OFFICE

CERTIFICATE OF CORRECTION

PATENT NO. : 6,425,333 B2
DATED : July 30, 2002
INVENTOR(S) : Josef Theurer and Herbert Wörgötter It is certified that error appears in the above-identified patent and that said Letters Patent is hereby corrected as shown below:

Title page,
Item [73], after "Vienna", replace "(AU)" with -- (AT) --.

Signed and Sealed this

Eleventh Day of February, 2003

JAMES E. ROGAN
*Director of the United States Patent and Trademark Office*